US005708987A

United States Patent [19]

Matthews

[11] Patent Number: 5,708,987

[45] Date of Patent: Jan. 20, 1998

[54] PANTYHOSE WITH UNCOVERED THIGH REGIONS

[76] Inventor: Carolyn C. Matthews, 420 Aiken Hunt Cir., Columbia, S.C. 29229

[21] Appl. No.: 781,379

[22] Filed: Jan. 21, 1997

[51] Int. Cl.[6] ..... A41B 11/04

[52] U.S. Cl. ..... 2/409; 2/242

[58] Field of Search ..... 2/409, 242, 239, 2/69, 240, 400, 404, 406, 407, 408; D2/980, 983

[56] References Cited

U.S. PATENT DOCUMENTS 4,903,345 2/1990 Oakley ..... 2/409

FOREIGN PATENT DOCUMENTS 3714299 12/1988 Germany ..... 2/409

OTHER PUBLICATIONS

Frederick's of Hollywood Catalog– p. 39; "Suspense" & 50–(F) Garter Belt Pantyhose, May 28, 1991.

Night'n Day Intimates Catalog—Valentines 1990 Garter Belt Hose, item B, Spring 1990.

*Primary Examiner*—Gloria Hale

[57] ABSTRACT

The present invention is pantyhose having a panty portion and a pair of leg portions that are connected to the panty portion by a plurality of straps extending along the posterior and anterior side of the thighs of the wearer. The panty portion, leg portions and the straps allow much of the upper thighs to remain uncovered, which provides increased comfort and coolness to the wearer. In the preferred embodiment, the leg portions are constructed from a hosiery material, while the panty portion and straps are constructed from a more comfortable material, such as cotton lace.

20 Claims, 2 Drawing Sheets

10
44
40
46
54
42
50
24
24
52
52
50
60
60
80
80
20
70
30
70
14
22
12

PANTYHOSE WITH UNCOVERED THIGH REGIONS

BACKGROUND OF THE INVENTION

1. Field of the Invention

The present invention relates to pantyhose. In particular, the present invention relates to pantyhose suitable for warm weather wear.

2. Discussion of Background

Pantyhose have been a part of fashion apparel for decades and have typically been made of nylon or silk to give a sheer appearance. Pantyhose reduce the visibility of bulges and garment seams when wearing tight fitting clothes. However, because of the choice of material and the elastic bands that help to hold the pantyhose on a wearer's body, pantyhose can be both hot and uncomfortable. First, the typical material that is used does not breathe well, nor does it wisk moisture away from the body. Second, the elastic bands within the pantyhose constrict the circulation of the wearer in that portion of the body and leave pressure lines. However, because of the sheer appearance and fashion, women continue to wear the traditional pantyhose.

There have been several attempts in the past to increase the comfort of pantyhose and stockings. For example, garter belts which support only leg portions provide some additional comfort and coolness; however, in form-fitting clothes, the outline and bulk of the garter belt detracts from appearances. Consequently, there is a need for a pantyhose that still provides the sheer and smooth form-fitting appearance, but which is also cool and comfortable to wear.

SUMMARY OF THE INVENTION

According to its major aspects and broadly stated, the present invention is a new design for pantyhose. The pantyhose in the preferred embodiment have two leg portions and a panty portion connected by a plurality of straps extending over the thigh of the wearer, preferably two in the front and two in the back, thus leaving much of the upper thigh uncovered. The straps are integrally connected to the leg holes in the panty potion and terminate in a pair of rings surrounding the thigh of the wearer, where they are sewn to the leg portions to hold the leg portions in place. Preferably the panty portion is made of a very lightweight, breathable fabric such as cotton lace. The leg portions are constructed from a typical hosiery material, such as nylon or silk. The straps are constructed from the same material as the panty portion and can be elasticized. Additionally, the straps can be made longer and the leg portions shorter when the present pantyhose are worn with longer skirts or slacks.

Using straps integrally connected to the panty and sewn to the leg portions is an important feature of the present invention. This feature enables large portions of the thigh to be uncovered for greater comfort in warm weather yet still provides support for the leg portions of the present pantyhose. Furthermore, this feature assures that the leg portions are securely held to the panty in proper alignment.

An important feature of the present invention is the use of the straps and the rings to support the leg portions. This feature enables the elimination of the hosiery material from the upper thigh for greater comfort but without the need to use elastic or garter belts in holding the leg portions in place. The straps also permit the use of parities that are cut in a variety of styles.

Another feature of the present invention is the combination of the leg hosiery and panties into a single garment.

With typical pantyhose that are worn over panties, there is a double layer of material about the lower torso of the wearer. By combining the two into a single garment, only a single layer of material from the panty covers the lower torso, while still providing the appearance of typical pantyhose, but with a cooler and more comfortable feel.

Still another feature of the present invention is the integral connection of the straps to the panty. Not only does this simplify manufacture, but it also assures that the material in contact with the body is lightweight and comfortable.

Yet another feature of the present invention is the aesthetic appearance of the pantyhose. Even though the pantyhose are worn as undergarments, it is important for the wearer to feel "pretty." In addition, there are times when the pantyhose may be visible, such that the wearer should feel comfortable and confident about their looks. Such an instance may be during a doctor's visit or in a changing room of a retail store. The present invention is aesthetically designed to allow the wearer to feel good about the clothes they are wearing.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
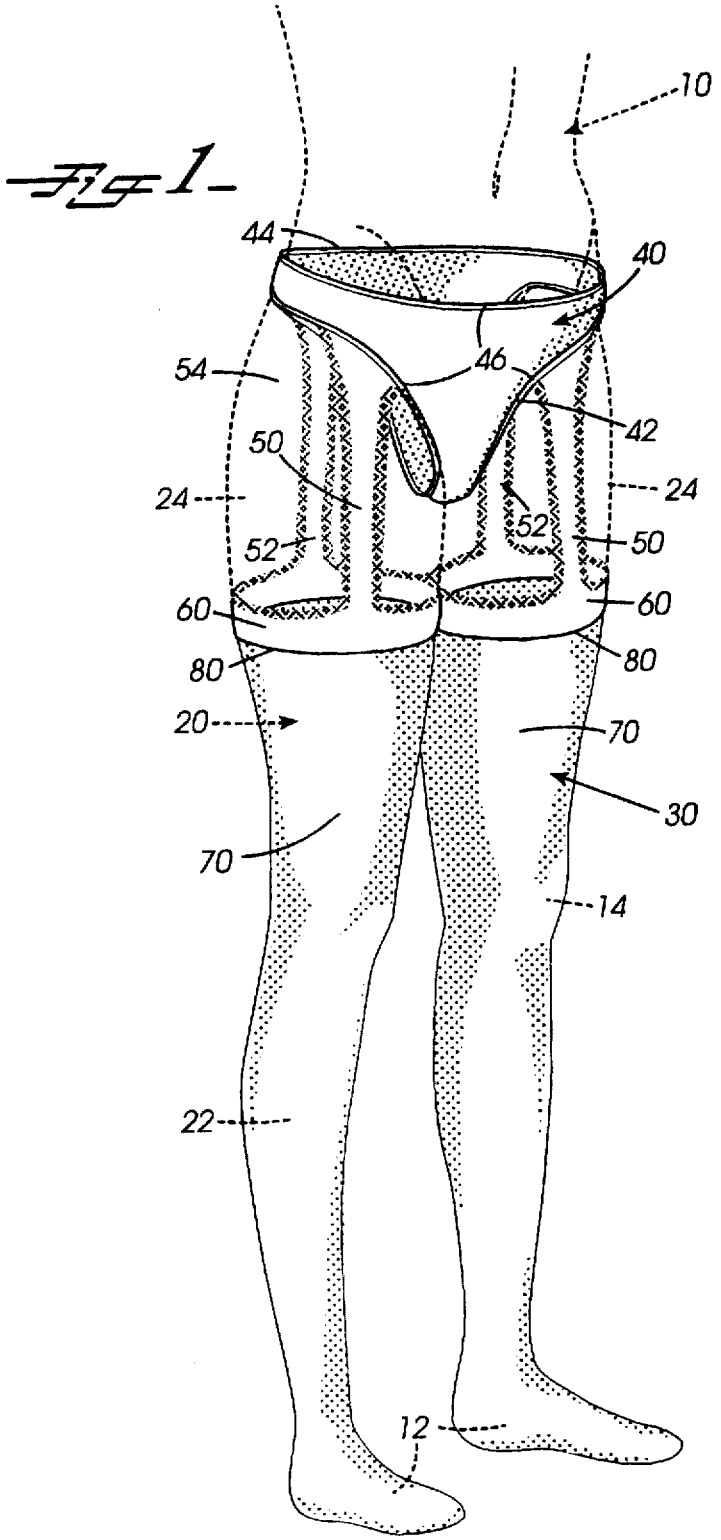
FIG. 1 is a perspective view of a pantyhose shown on a woman's figure illustrated in dashed lines, according to a preferred embodiment of the present invention.

Referring now to the figures, the present invention, a new and unobvious style of pantyhose 30, is shown on the figure of a woman, the wearer 10. In its preferred embodiment, pantyhose 30 comprises a panty potion 40, a pair of leg portions 70, and a plurality of straps 50, 52 connecting panty portion 40 to leg portions 70.

Panty portion 40 can be constructed from any comfortable material, such as cotton or satin, and in the preferred embodiment is made from cotton lace. In addition, panty portion 40 could be made from an open-knit material formed of hydrophobic fibers in order to wisk moisture away from the body. A material having these characteristics is disclosed in U.S. Pat. No. 5,152,014. Panty portion 40, in the preferred embodiment, is similar to other types of women's panties, having two leg holes 42 and a waist 44 Panty portion 40 may be provided with elastic members 46 in leg holes 42 and waist 44 to help support panty portion 40 on wearer 10. In addition, panty portion 40 may have a control top or other style of panty, to provide a slimmer look to the wearer 10.

Leg portions 70 are constructed from a hosiery material which has elastic characteristics. Each leg portion 70 covers one foot 12 and extends up the leg 20, covering the lower leg 22 of the wearer 10. Leg portion 70 continues over the knee 14 and terminates in the thigh region 24, having a circular opening so that the wearer 10 can easily put her foot 12 within leg portion 70.

Hosiery material connotes the use of relatively flexible and elastic material, preferably fiber such as nylon or silk, and which is form-fitting and not baggy. However, there are variations in the types of hosiery material that are available, for instance leg portions 70 may be seamed or unseamed, and the foot portion may be a sandal foot, stirrup foot, or completely cover the foot, and have reinforced toes or heels or both. In addition, hosiery material may be construed to cover tights, stockings, leggings, and any other garment which, for example, may have a cotton construction, but have portions of elastic material woven therein to provide the desired form fit. Consequently, those of ordinary skill in the art will recognize that various type of hosiery materials may be used for leg portions 70 without departing from the spirit and scope of the present invention.

Straps 50, 52 are basically strips of material that are connected at their proximal ends to panty portion 40 adjacent to leg holes 42. Straps 50, 52 descend along the thigh region 24 of the wearer 10, terminating in a ring 60 at their distal ends. In the preferred embodiment, there are four straps 50, 52, two for each leg 20, an anterior strap 50 and a posterior strap 52. In the following discussion, straps 50, 52 will be described in greater detail with reference to only one leg 20, as it will be recognized that straps 50, 52 for the other leg 20 are identical.

Anterior strap 50 descends from its connection to panty portion 40 adjacent to leg hole 42 along the anterior side of the thigh region 24, while posterior strap 52 descends from its attachment to panty portion 40 adjacent to leg hole 42 along the posterior side of the thigh region 24. Straps 50, 52 are preferably integrally connected to panty portion 40 and can be a single piece of material or can be sewn together. However, it is important that straps 50, 52 be connected to panty portion 40 in as little of an intrusive manner as possible, so that when the wearer 10 is in a seated position, the connection of posterior strap 52 to panty portion 40 does not restrict the circulation in that area of the body.

Figure 3:
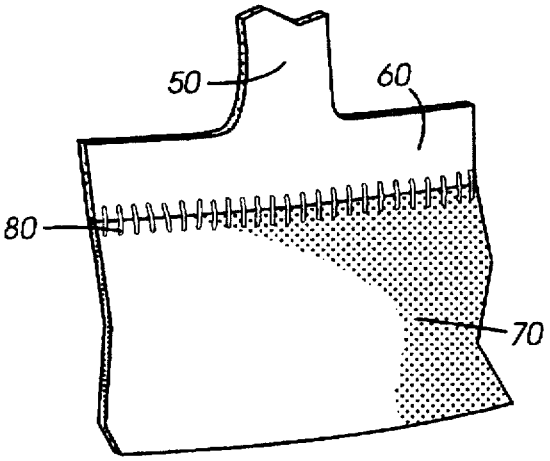
FIG. 3 is a detail view of a ring connected to a leg portion of a pantyhose according to a preferred embodiment of the present invention.

As stated above, anterior and posterior straps 50, 52 terminate in a ring 60 at their distal ends which surrounds a portion of the leg 20, preferably the thigh region 24, when pantyhose 30 are on the wearer 10. Ring 60 is connected to the top of leg portions 70 about its perimeter, thus holding up leg portion 70 on leg 20. In the preferred embodiment, ring 60 is constructed from the same material as straps 50, 52 and is integral with straps 50, 52. However, ring 60 could be a separate portion that is connected to straps 50, 52, but should be constructed with comfort in mind, much like the connections of posterior strap 52 to panty portion 40. As shown in FIG. 3, ring 60 is connected to leg portion 70 by a plurality of stitches. However, these stitches 80 should also be very non-intrusive, so as not to restrict the circulation of and cause discomfort to the wearer 10.

The tops of rings 60, panty portion 40, and anterior and posterior straps 50, 52 define openings 54 along the medial and lateral side of the thigh region 24. Openings 54 can vary in size as will be discussed below, but nonetheless provide an uncovered portion to the leg 20 of the wearer 10, thus reducing the amount of heat retained by the body and increasing the comfort of the wearer 10.

Figure 2A:
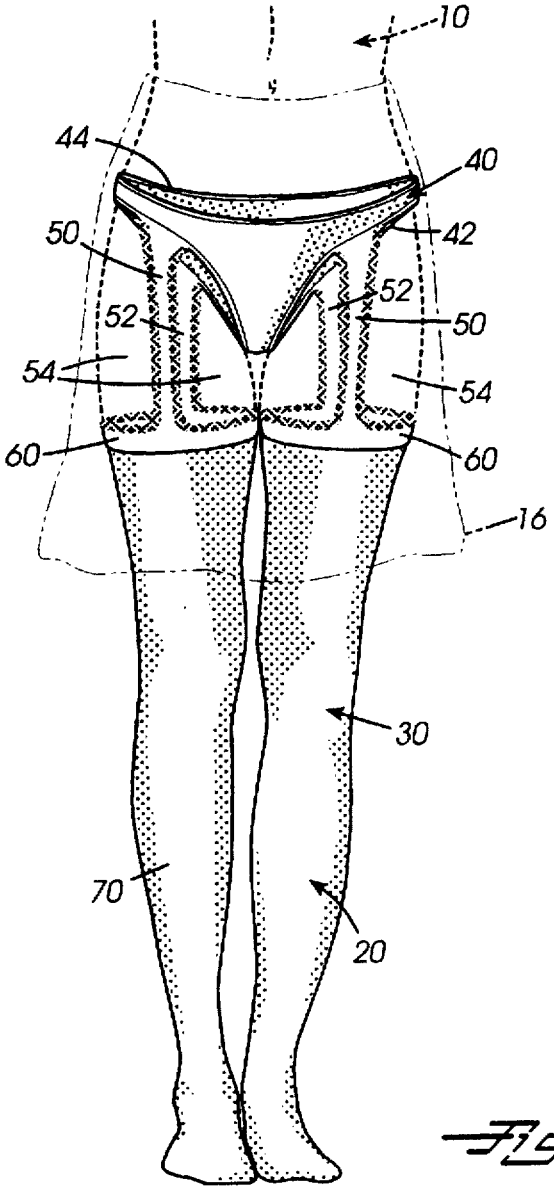
FIG. 2A is a front view of a pantyhose having relatively short straps shown on a woman's figure illustrated in dashed lines, according to a preferred embodiment of the present invention.
Figure 2B:
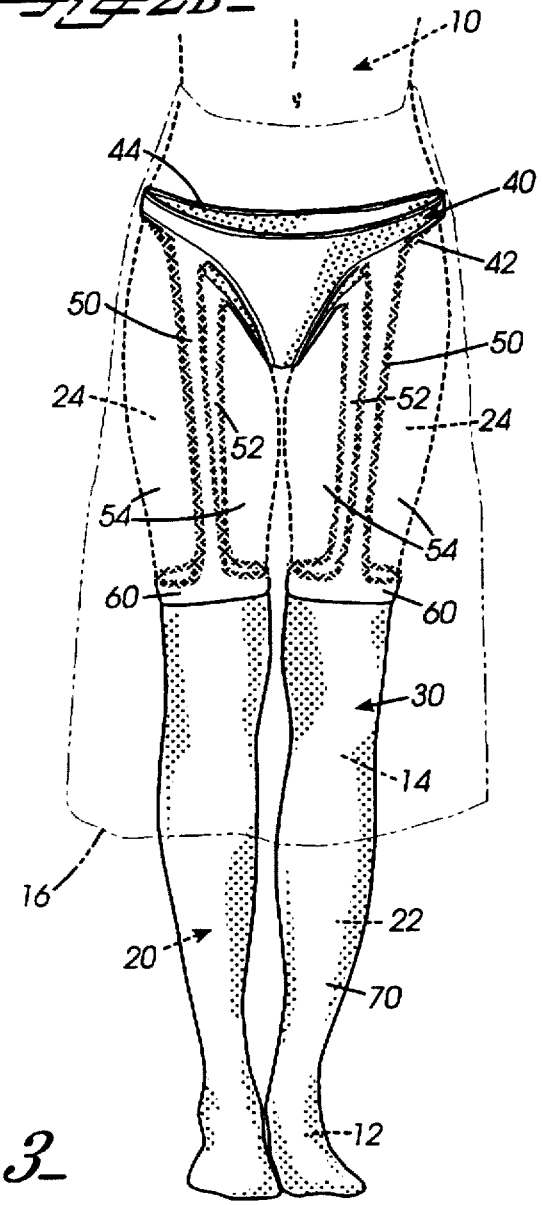
FIG. 2B is a front view of a pantyhose having relatively long straps shown on a woman's figure illustrated in dashed lines, according to a preferred embodiment of the present invention.

Pantyhose 30 can have different styles, as shown in FIGS. 2A and 2B, with straps 50, 52 having a varied length. For example, if a woman wears a skirt 16 as shown in FIG. 2A, straps 50, 52 would necessarily need to be shorter and leg portions 70 would need to extend farther up the leg 20, over the mid portion of the thigh region 24. However, if a woman is planning to wear a longer skirt 16, as shown in FIG. 2B, then straps 50, 52 could be longer and leg portions 70 could end closer to the knees 14, thus increasing the size of openings 54 and potentially providing a more comfortable and cooler garment.

It is also contemplated that anterior strap 50 and posterior strap 52, including ring 60, could be made from a material having elastic characteristics, so that leg portions 70 are more securely held in place on the wearer's leg 20. Furthermore, there is no requirement that two straps 50, 52 be used for each leg 20, and thus it will be recognized that any number of straps may be used. However, the preferred number is two per leg, because this will maximize the support for the leg portion 70, while increasing the size of openings 54.

It will be apparent to those skilled in the art that many changes and substitutions can be made to the preferred embodiment herein described without departing from the spirit and scope of the present invention as defined by the appended claims.

What is claimed is:

1. A pantyhose comprising:

a panty portion;

a pair of leg portions for covering the lower legs of a wearer and extending up the leg to above the knee when on the wearer; and a plurality of straps integrally connected to said panty portion and extending over the thigh when on the wearer, said plurality of straps connected to said pair of leg portions and defining openings over the thighs when on the wearer.

2. The pantyhose as recited in claim 1, wherein said pair of leg portions are dimensioned to extend to the middle of the thighs of the wearer.

3. The pantyhose as recited in claim 1, wherein said pair of leg portions are dimensioned to extend to just above the knees of the wearer.

4. The pantyhose as recited in claim 1, wherein said panty portion is constructed from cotton lace.

5. The pantyhose as recited in claim 1, wherein said plurality of straps extend over the anterior and the posterior sides of the thighs when on the wearer.

6. The pantyhose as recited in claim 1, wherein said openings extend over the medial and lateral sides of the thighs, when said pantyhose are on the wearer.

7. A pantyhose comprising:

a panty portion having two leg holes;

a pair of leg portions for covering the legs of a wearer and extending from the feet to just above the knees when on the wearer; and a plurality of straps, each strap of said plurality of straps having a distal end and a proximal end, said proximal end connected to said panty portion adjacent to one leg hole of said two leg holes, said distal end having a ring, said ring connected to one of said leg portions.

8. The pantyhose as recited in claim 7, wherein said plurality of straps define openings over both the medial and lateral sides of the thighs when on the wearer.

9. The pantyhose as recited in claim 7, wherein said plurality of straps extend over the anterior and the posterior sides of the thighs when on the wearer.

10. The pantyhose as recited in claim 7, wherein said panty portion is integrally connected to said straps, and wherein said rings are sewn to said pair of leg portions.

11. The pantyhose as recited in claim 7, wherein said plurality of straps further comprise a first strap extending along the anterior side of the thigh when on the wearer and a second strap extending along the posterior side of the thigh when on the wearer.

12. A method for making pantyhose, said method comprising the steps of:

forming a panty having leg holes;

forming a plurality of straps, each strap having a proximal and a distal end;

forming rings on said distal ends;

forming leg portions;

attaching said proximal ends of each strap of said plurality of straps to said panty adjacent to said leg holes; and attaching said rings to said leg portions.

13. The method as recited in claim 12, wherein said rings are attached to said leg portions by sewing.

14. The method as recited in claim 12, wherein said straps are dimensioned to extend to just above the knees of the wearer.

15. The method as recited in claim 12, wherein said straps are dimensioned to extend to the middle of the thigh of the wearer.

16. The method as recited in claim 12, wherein said panty is made of cotton lace.

17. The method as recited in claim 12, wherein said plurality of straps are integrally attached to said panty.

18. The method as recited in claim 12, wherein said plurality of straps are two straps per leg.

19. The method as recited in claim 12, wherein said plurality of straps are two straps per leg and are attached to said panty so as to extend along the anterior and posterior sides of the thighs when on the wearer.

20. The method as recited in claim 12, wherein said panty and said straps are made of cotton lace and are integrally attached.

* * * * *